US006666572B2

(12) United States Patent
Akiyama

(10) Patent No.: US 6,666,572 B2
(45) Date of Patent: Dec. 23, 2003

(54) VEHICULAR LAMP

(75) Inventor: Kiyohiro Akiyama, Kanagawa-ken (JP)

(73) Assignee: Ichikoh Industries, Ltd., Tokyo (JP)

( * ) Notice: Subject to any disclaimer, the term of this patent is extended or adjusted under 35 U.S.C. 154(b) by 1 day.

(21) Appl. No.: 10/079,538

(22) Filed: Feb. 22, 2002

(65) Prior Publication Data

US 2002/0159272 A1 Oct. 31, 2002

(30) Foreign Application Priority Data

Feb. 23, 2001 (JP) ..... 2001-048436

(51) Int. Cl.[7] ..... F21V 5/02; F21W 101/10

(52) U.S. Cl. ..... 362/522; 362/520; 362/332; 362/339

(58) Field of Search ..... 362/509, 522, 362/521, 520, 308, 309, 332, 336, 339

(56) References Cited

U.S. PATENT DOCUMENTS 4,754,374 A * 6/1988 Collot ..... 362/61
5,964,525 A * 10/1999 Albou ..... 362/522
6,273,591 B1 * 8/2001 Albou ..... 362/333
6,364,514 B1 * 4/2002 Natsume ..... 362/522

FOREIGN PATENT DOCUMENTS

JP 2000-215711 8/2000

* cited by examiner

*Primary Examiner*—Laura K. Tso
(74) *Attorney, Agent, or Firm*—Foley & Lardner

(57) ABSTRACT

A lens (2) disposed in front of a lamp housing (11) has a light transmitting portion (2*a*) thereof zoned at the rear side into a central section (X) and lateral sections (Y) at both sides thereof, the central and lateral sections (X, Y) being additionally divided into blocks (A, B, C, D, E, F, G), respectively, and prism elements (p) in the blocks are configured so that those (p) in the central section (X) control reflected light from a reflector (12) as reference light, and those (p) in the lateral sections (Y) control direct light from a light source bulb (10) as reference light, thereby providing illumination ranges (J, K) within a light distribution range (LDR) conforming to a light distribution specification (S).

4 Claims, 8 Drawing Sheets

VEHICULAR LAMP

BACKGROUND OF THE INVENTION

1. Field of the Invention

This invention relates to a vehicular lamp, and more particularly to a vehicular lamp applicable to a back lamp of a rear combination lamp.

2. Description of the Related Art

Vehicular lamps are configured to "control, by the diffraction of a lamp element, the direction of projection" (hereinafter simply referred to as "control") of light striking to the lamp element directly or indirectly from a light source bulb.

Conventional vehicular lamps fall in one of a type which is configured with a reflector for reflecting light from a light source bulb and adapted to control the reflected light, as illustrated by FIG. 6A, and a type which is adapted to control direct light from a light source bulb, as illustrated by FIG. 6B. In the reflected-light controlling type of FIG. 6A, light L from a light source bulb 10 is reflected in parallel with an optical axis, by a reflector 12 formed on an inside of a lamp housing 11, and the reflected light LRi is controlled by a fisheye lens element or cylindrical lens element 13 provided in a light transmitting portion of a lens 2 for distribution of projected light LRo. On the other hand, in the direct-light controlling type of FIG. 6B, direct LDi from a light source bulb 10 is controlled by a Fresnel lens element 14 provided in a light transmitting portion of a lens 2 for distribution of projected light LDo. It is noted that, in this Specification, like elements are designated by like reference characters, to eliminate redundancy.

To this point, light distribution of vehicular lamp is regulated by a standard of the country or district, for example, FMVSS SAE J593c, or E/ECE/324, E/ECE/TRANS/505 (Rev. 1/Add. 22, Rev. 1/Amend. 2, Apr. 30, 1998), Regulation No. 23 which requires a lamp to have, as shown in FIG. 7, in a prescribed light distribution range LDR on an imaginary screen 20 at a distance of 10 m, a distribution of light with a luminous intensity equivalent to or greater than a specified value (cd) in a round mark at any of designated upward/downard/leftward/rightward angular positions relative to the optical axis.

However, when the vehicular lamp of FIG. 6A is configured, as shown in FIG. 8A, with a lens 15 having a cylindrical lens element 15*a* for controlling the reflected light LRi as reference light, the direct light LDi from light source bulb 10 is projected outside the light distribution range LDR, resulting in a proportion of available light reduced to 30 to 40%. On the other hand, if the direct light LDi is controlled as reference light, most of projected light Ldo thereof is concentrated and most of projected light LRo of the reflected light LRi is deviated outside the light distribution range LDR, still resulting in a reduced proportion of available light.

Conventional countermeasure was, e.g. the provision of a reflector with an increased reflective surface area or the like, thus constituting a difficulty to make the lamp compact.

SUMMARY OF THE INVENTION

It therefore is an object of this invention to provide a vehicular lamp which can provide a required distribution of luminous intensity within a prescribed light distribution range without increasing a reflective surface area or the like, thus allowing for the lamp to be made compact with case.

To achieve the object, according to an aspect of the invention, there is provided a vehicular lamp comprising: a light source bulb; a reflector for reflecting light from the light source bulb; and a lens provided with a light transmitting portion formed with a set of prism elements for reflected light from the reflector and direct light from the light source bulb to strike thereto, the set of prism elements being configured for controlling the reflected light and the direct light to give a distribution of required luminous intensities in a prescribed light distribution range.

According to this aspect of the invention, both reflected light and direct light are available to illuminate a prescribed light distribution range.

BRIEF DESCRIPTION OF THE DRAWINGS

The above and foregoing objects and novel features of this invention will more fully appear from the following detailed description when the same is read in conjunction with the accompanying drawings, in which.

DETAILED DESCRIPTION OF THE PREFERRED EMBODIMENT

There will be described a preferred embodiment of this invention, with reference to the accompanying drawings.

Figure 1A:
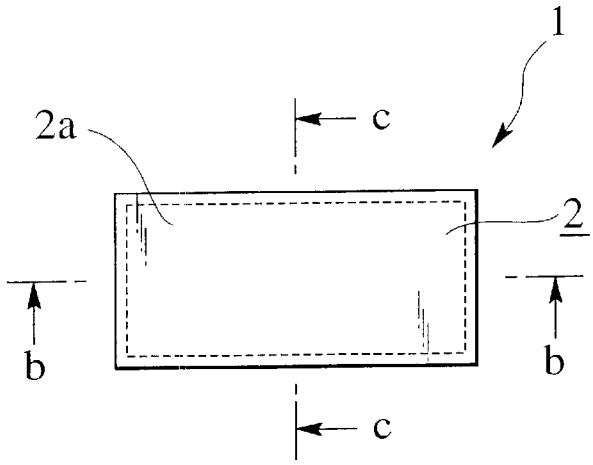
FIG. 1A is a plan view of a vehicular lamp according to an embodiment of this invention, as the lamp is in an upright position.
Figure 1B:
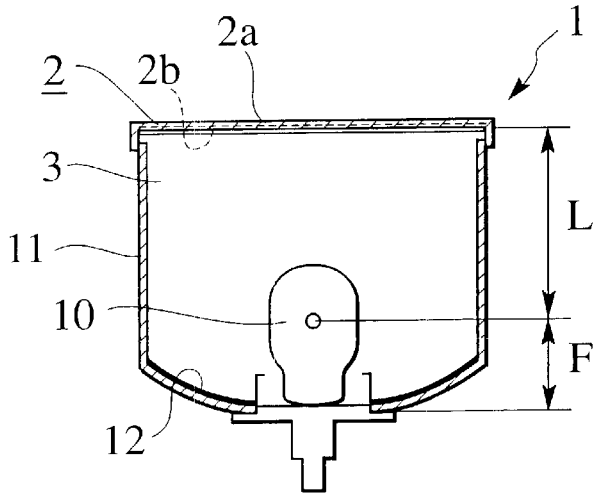
FIG. 1B is a cross-sectional view taken along line b—b of FIG. 1A.
Figure 1C:
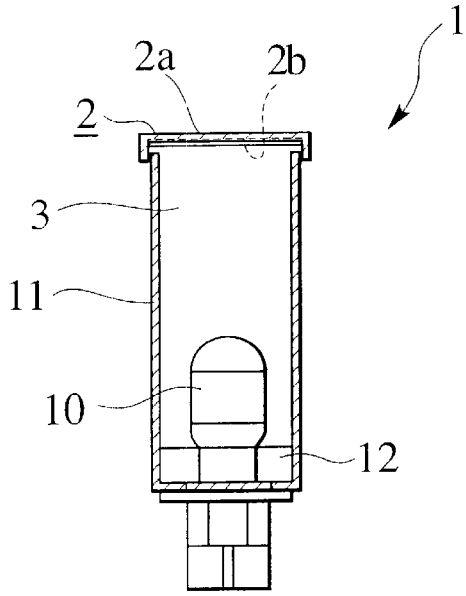
FIG. 1C is a cross-sectional view taken along line c—c of FIG. 1A.

FIGS. 1A to 1C show a vehicular lamp 1 as an embodiment of this invention. The vehicular lamp 1 has a lamp housing 11, a lens 2 disposed in front of the housing 11, a lamp chamber 3 defined by the housing 11 and the lens 2, a light source bulb 10, and a reflector 12 provided in the lamp chamber 3. The reflector 12 reflects light emitted from the light source bulb 10 toward the lens 2. The lens 2 has an apparently flat light-transmitting portion 2*a* of a rectangular form. The reflector 12 is made of aluminum evaporated onto an inner surface of the lamp housing 11, constituting part of a paraboloid of revolution with the light source center of the light source bulb 10 as its focal point. The light emitted from the light source bulb 10 is reflected by the reflector 12 toward the lens 2, to be parallel to the optical axis.

There will be described configuration of the lens 2.

Figure 2A:
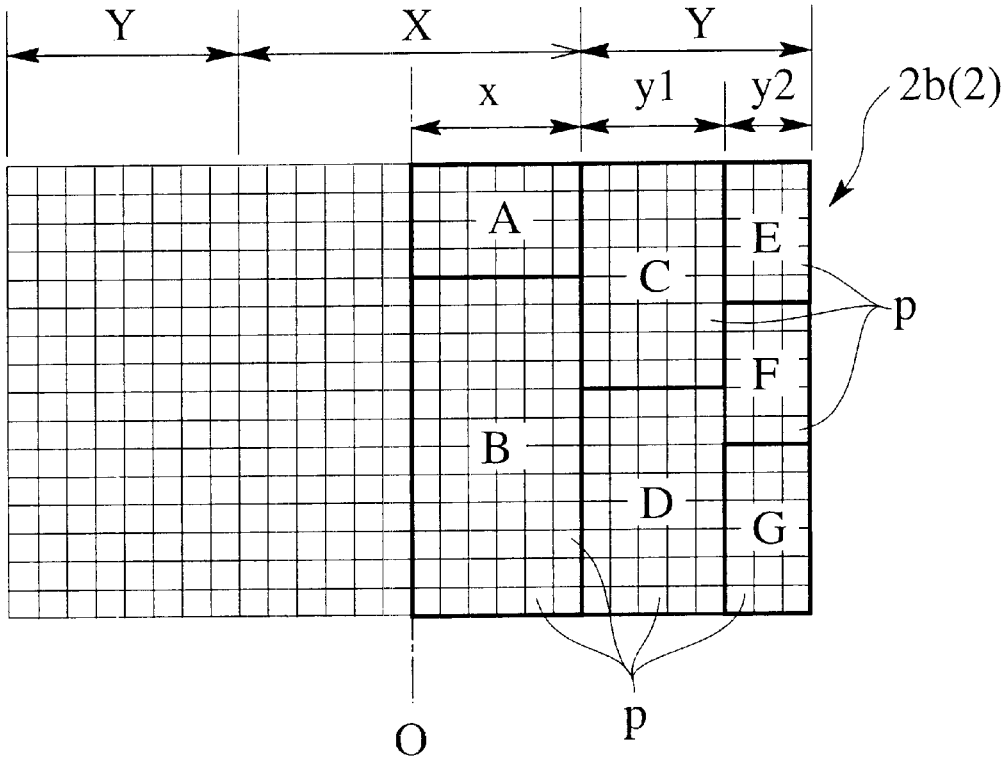
FIG. 2A is a rear view of a light-transmitting portion of a lens of the vehicular lamp.

As shown in FIG. 2A (rear view of the lens 2), a rear surface 2*b* (See FIG. 1B) of the light-transmitting portion 2*a* of the lens 2 is zoned into a central section X with the bulb center of the light source bulb 10 as the reference center, and lateral sections Y, Y positioned at the left and right of the centeral section X. These sections align in the longitudinal direction of the light-transmitting portion 2*a*, to be line-symmetrical about a center line O of the central section X. It is noted that, for convenient comprehension, description will be made simply of the right half of the light transmitting portion 2*a* of lens 2 in FIG. 2A, as the left half is symmetrical thereto.

In this embodiment, the lateral section Y is additionally zoned into wide and narrow sections y1 and y2, so that the right half of lens 2 is zoned, at the rear side of the light-transmitting portion 2*a*, into a central half section x as a right half of the central section X, the wide section y1, and the narrow section y2. The central half section x is greatest in width, and the narrow section y2 smallest.

The central section X and the lateral section Y are vertically divided into a plurality of blocks, respectively. That is, the central half section x is divided into an upper block A and a lower block B having a greater area than that of the block A. The wide section y1 is substantially equally divided into upper and lower blocks C and D. The narrow section y2 is substantially equally divided into three blocks, E, F, and G.

Figure 3:
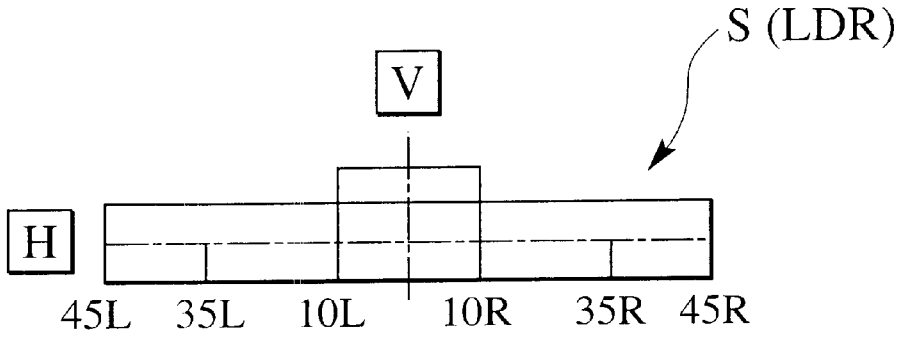
FIG. 3 is a diagram describing a light distribution according to a standard.
Figure 4A:
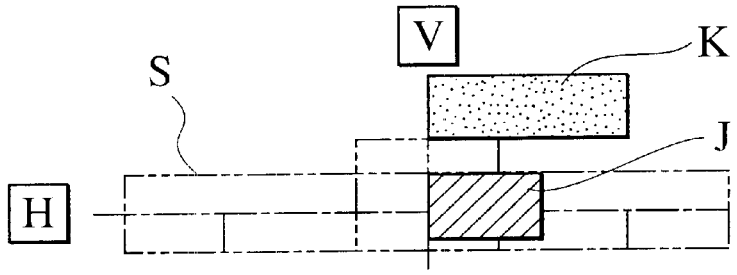
FIGS. 4A to 4G are diagrams of illumination patterns describing illumination ranges by blocks of lens elements of the lens of FIG. 2A.
Figure 4B:
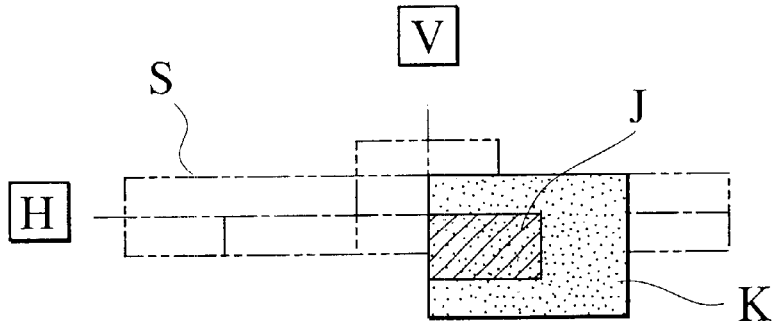
Figure 4C:
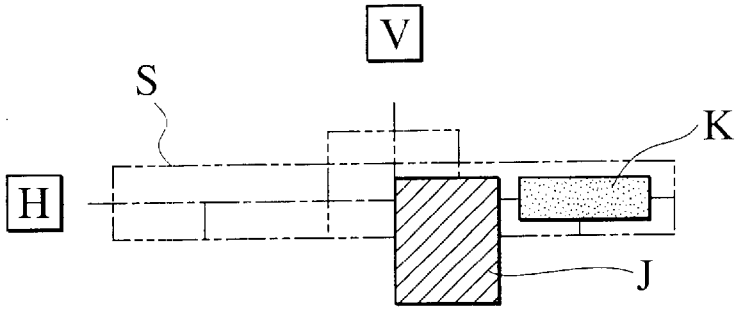
Figure 4D:
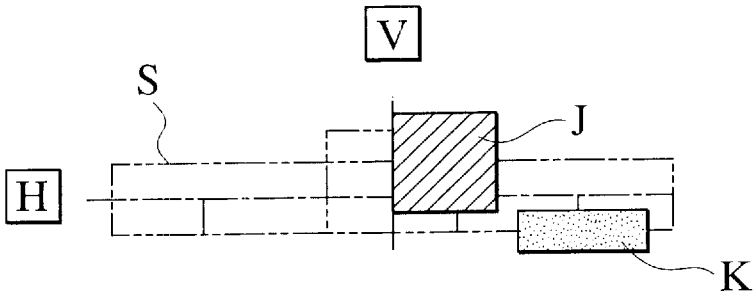
Figure 4E:
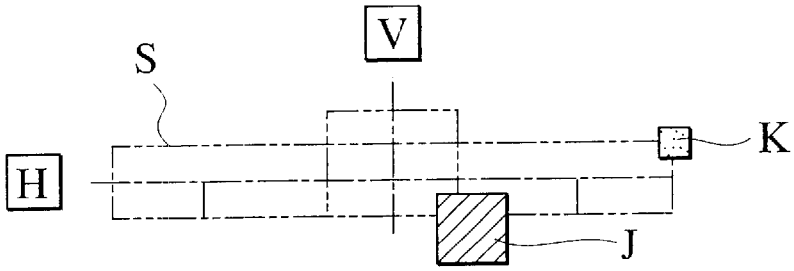
Figure 4F:
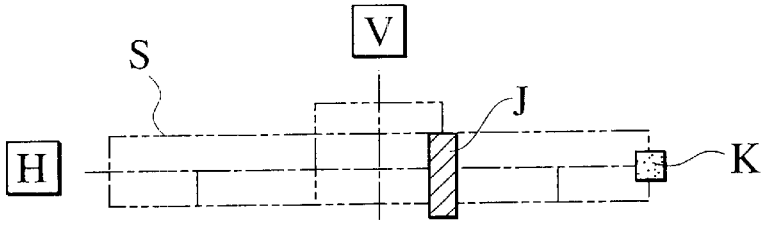
Figure 4G:
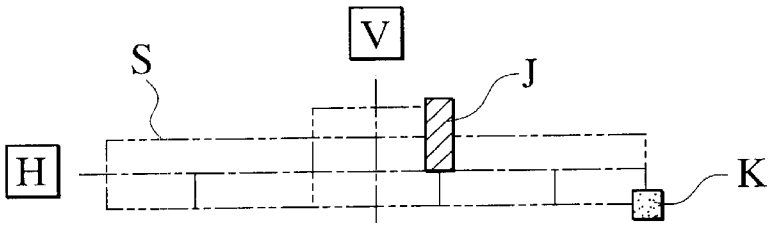

The blocks A and B of the central section X have prism elements configured to control light reflected by the reflector 12 as reference light, and the blocks C, D, E, F and G of the lateral section Y have prism elements p configured to control light directly emitted from the light source bulb 10 as reference light, to thereby provide a distribution of required luminous intensities in a light distribution range LDR. FIG. 3 is a graph illustrating an illumination pattern, in which reference characters H and V denote horizontal and vertical directions, respectively. The luminous intensity distribution adopted in this embodiment is depicted in FIG. 3, where high luminous intensities are required in a range between angular positions 10L and 10R.

The light source bulb 10 has a vertical filament. Each of the blocks A, B, C, D, E, F, and G is composed of a set of prism elements p. In this embodiment, each prism element p is 2×2 mm square in plan.

In the vehicular lamp 1, the light source center of the light source bulb 10 is set at a focal distance F from the reflector 12. Table 1 lists preferable light projection angles specified for prism elements p of the blocks A, B, C, D, E, F, and G, providing that L=40 mm and F=20 mm, where L is a distance between the light source center of the light source bulb 10 and the lens 2, and F is a local distance from the reflector 12.

Figure 2B:
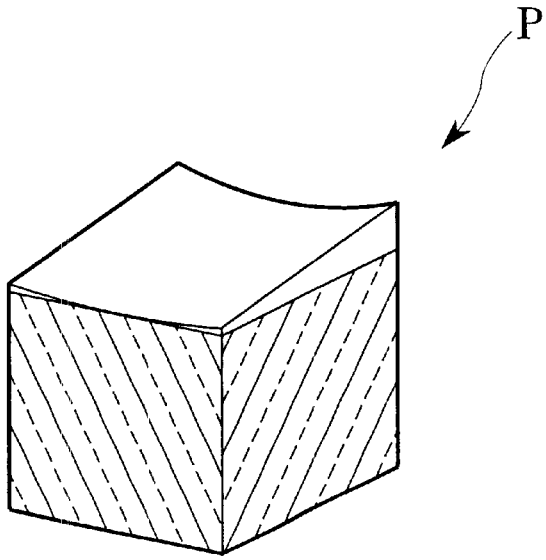
FIG. 2B is a perspective view of a cutout prism as a lens element of the lens of FIG. 2A.

Table 1 refers to the right half of the light-transmitting portion 2*a* of the lens 2. For the left half, e.g. "30R" and "45R" in the column of horizontal projection angle are to be read as "30L" and "45L," respectively, like others. Prism elements p in the same block are configured to be identical in shape. FIG. 2B illustrates the shape of element p recessed spherical at the top.

TABLE 1

| Block | Reference Light | Horizontal Projection angle | Vertical Projection angle | Horizontal Diffusion Angle | Vertical Diffusion Angle |
|---|---|---|---|---|---|
| A | Reflected (parallel) | V | H | 20° | 0° |
| B | Reflected (parallel) | V | 5D | 20° | 0° |
| C | Direct | 30R | H | 10° | 0° |
| D | Direct | 30R | 5D | 10° | 0° |
| E | Direct | 45R | 5U | 2° | 0° |
| F | Direct | 45R | H | 2° | 0° |
| G | Direct | 45R | 5D | 2° | 0° |

The prism elements p constituting the lateral section Y are preferably configured to have a greater horizontal projection angle in a zone spaced farther from the light source bulb 10 (i.e., in the narrow section y2). In this embodiment, prism elements p in the blocks C and D are configured to have a horizontal projection angle 30R, while those in the blocks E, F, and G have a horizontal projection angle 45R.

This configuration provides sufficient illumination to both sides of the light distribution range LDR.

FIGS. 4A to 4G show respective relationships between illumination ranges of the blocks A, B, C, D, E, F and G according to the specification of Table-1 and the luminous intensity distribution standard. In these figures, reference character J denotes an illumination range of reflected light, and K denotes an illumination range of the direct light. The illumination ranges J of reflected light in all the blocks A, B, C, D, E, F and G fall entirely or partially within the range of an intensity-distribution-specification diagram S. In the blocks A, B, C and D, the illumination ranges J of reflected light are adjacent to the center line. The illumination ranges K of direct light in all the blocks except the block A, that is, in B, C, D, E, F and G, fall entirely or partially within the range of the diagram S. In particular, the illumination range K of direct light in the block B occupies a large area adjacent to the center line.

Figure 5:
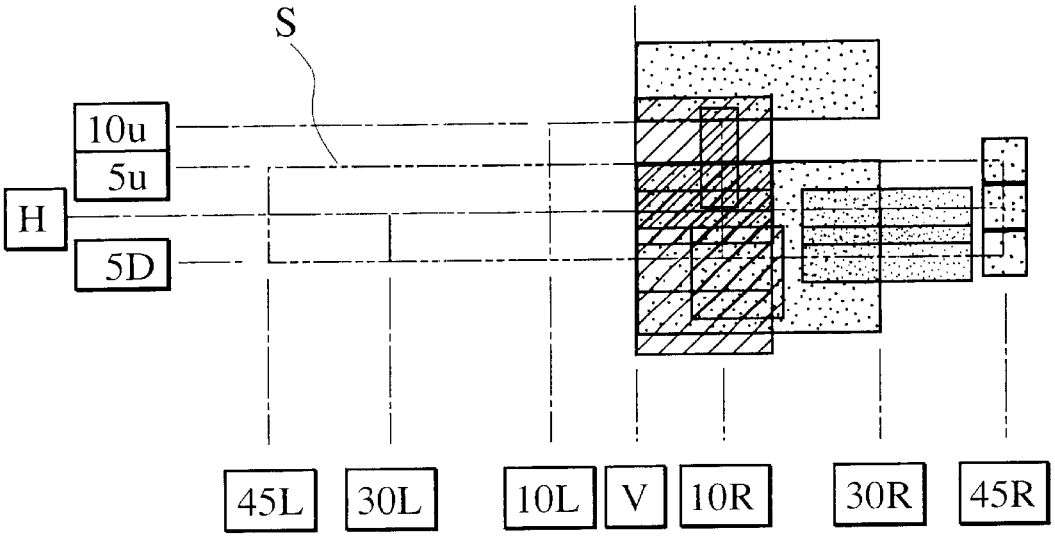
FIG. 5 is a diagram of illumination pattern describing a lapped range of the illumination ranges of whole lens element blocks of the lens of FIG. 2A.
Figure 6A:
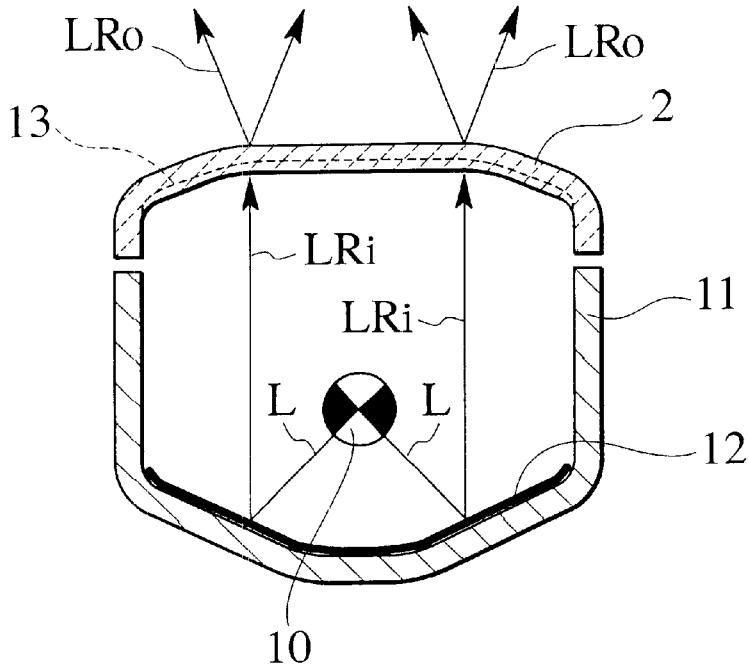
FIG.6A PRIOR ART
FIG. 6A is a sectional view of a conventional reflected-light controlling vehicular lamp.
Figure 6B:
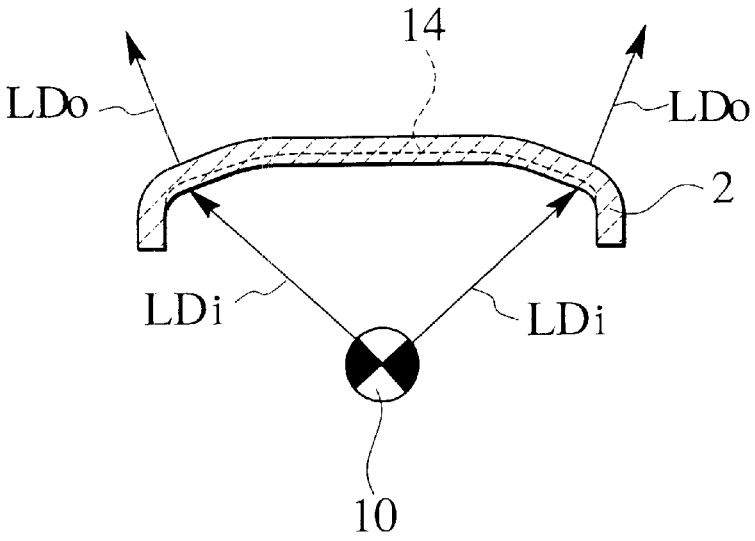
FIG.6B PRIOR ART
FIG. 6B is a sectional view of a conventional direct-light controlling vehicular lamp.
Figure 7:
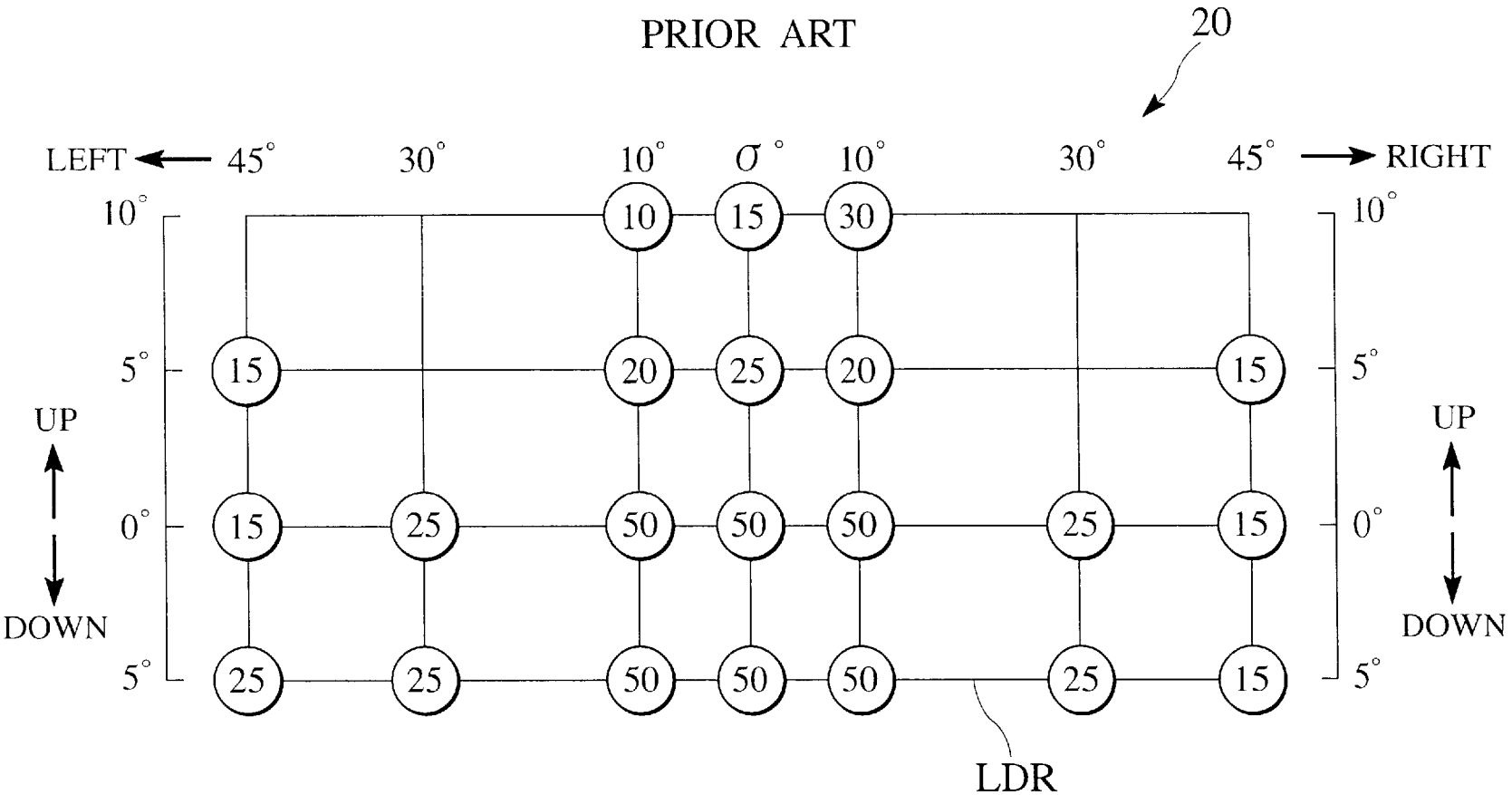
FIG.7 PRIOR ART
FIG. 7 is a diagram describing a light distribution range of a standard.

FIG. 5 shows the illumination ranges J and K of reflected light and direct light in all the blocks A, B, C, D, E, F and G, as they are lapped. Although only those in the right half are shown in FIG. 5, those in the left half have identical illumination patterns. FIG. 5 clearly shows that the central section X in the light transmitting portion 2*a* of the lens 2 is the portion where reflected light from the reflector 12 is most transmitted. Thus, from the section X, reflected light is most projected outside a desirable range. From the lateral section Y, direct light is most projected outside a desirable. The respective shapes of prisms in the central section X and the lateral section Y are configured to control reflected light from the reflector 12 and direct light of the light source bulb 10 as reference light, respectively, for efficiently control of light projection of the reflected and direct light, directing the projected light within a desirable range according to the luminous intensity distribution specification.

The central section X and the lateral section Y of the light transmitting portion 2*a* of the lens 2 are divided into the blocks A and B and the blocks C, D, E, F and G, respectively, so that the illumination ranges of reflected light from the reflector 12 and the direct light from the light source bulb 10 are controlled in position within the line diagram S in good balance.

Figure 8A:
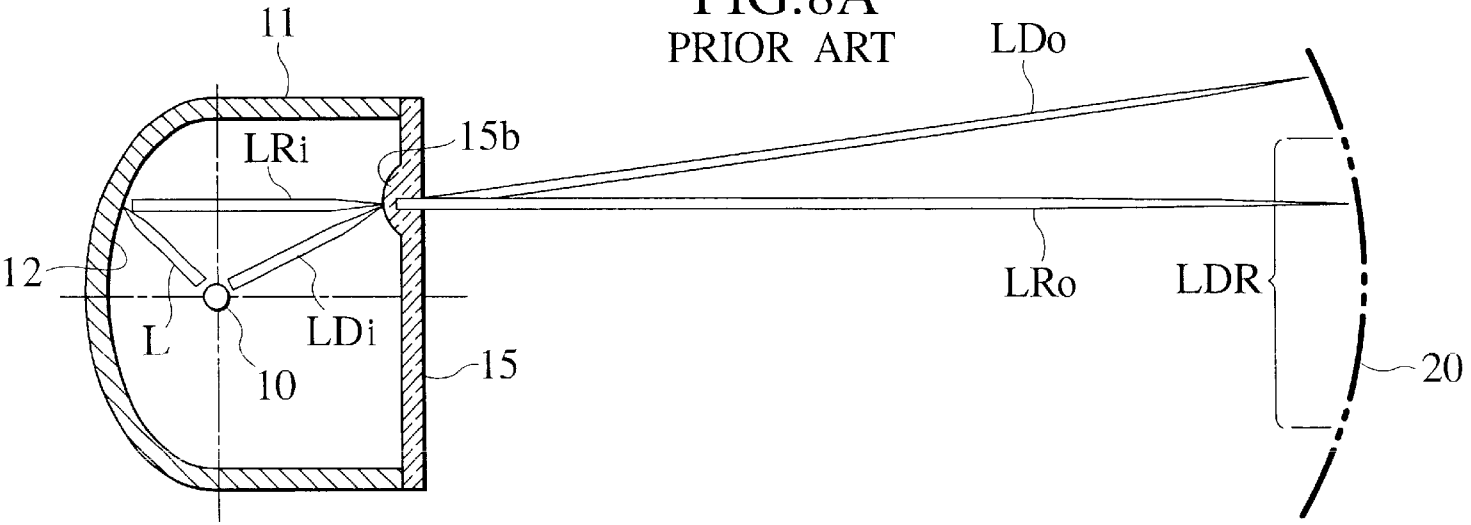
FIG.8A PRIOR ART
FIG. 8A is a sectional view of a conventional lamp.
Figure 8B:
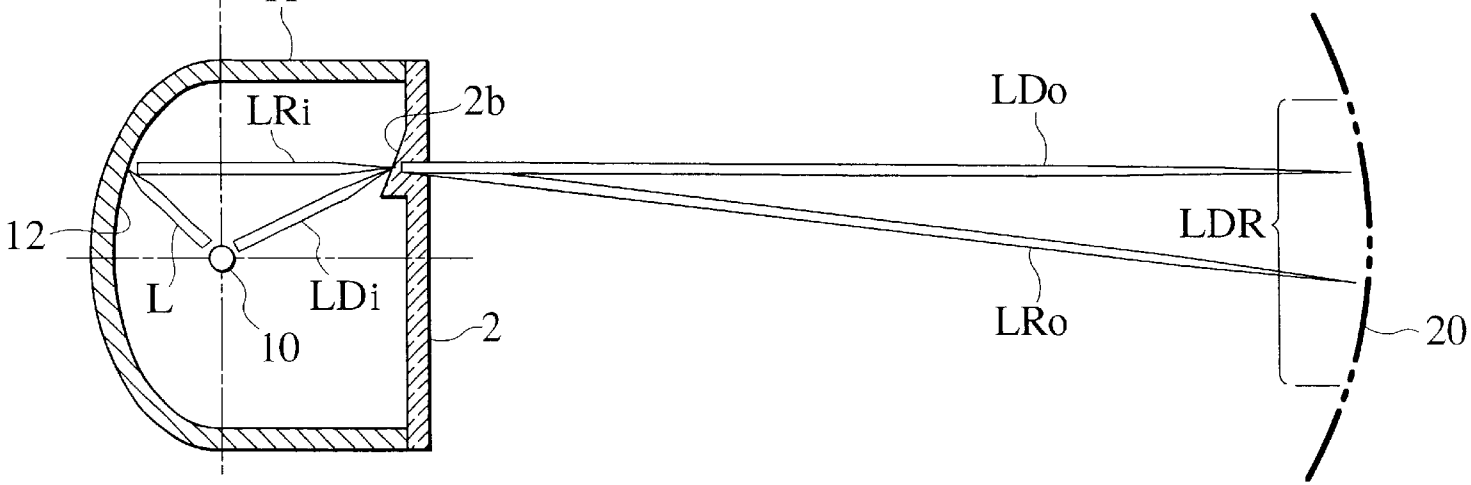
FIG. 8B is a sectional view of the lamp of FIG. 1A.

The lens 2 thus concentrates light in the range between 10L and 10R which requires a high luminous intensity distribution value within the luminous intensity distribution specification while arranging illumination ranges in other portions within the luminous intensity distribution specification in good balance, providing an illumination pattern with sufficient luminous intensity meeting the specification S, as depicted in FIG. 8B.

In this manner, the vehicular lamp 1 improves efficiency in utilizing a light beam from the light source bulb 10 in relation to the luminous intensity distribution specification, resulting in an entirely smaller lamp.

The vehicular lamp 1 uses a vertical filament in the light source bulb 10 to set the vertical diffusion angle of the prism elements at 0° C. This allows using the same design of the prism elements p irrespective of difference in the installing position of the lens 2 (whether the surface opposite to the light source bulb 10 is flat or inclined). In FIGS. 1A to 1C, the lens 2 of the vehicular lamp 1 has the surface opposite to the light source bulb 10 (rear surface) being flat. If the lens 2 is installed in a manner that the opposing surface (rear surface) is inclined, the same design specification of the prism elements p provide the same functional effects.

In this embodiment, each of the blocks A, B, C, D, E, F and G is composed of a set of prism elements p. This enables highly precise control of the illuminating position of each block, improving efficiency in utilizing a light beam of the light source bulb 10 in relation to the luminous intensity distribution specification.

In this embodiment, prism elements p are formed in a lattice. This facilitates luminous intensity distribution and manufacture of the prism elements p.

According to this embodiment, there is provided a vehicular lamp which comprises: a lamp housing; a lens provided at a front face of the lamp housing; a lamp chamber defined by the lamp housing and the lens; a light source bulb provided in the lamp chamber; and a reflector for reflecting light of the light source bulb toward the lens; the lens having a light-transmitting portion comprising a plurality of prism elements; the prism elements being configured to control direct light from the light source bulb and reflected light from the reflector, providing an illumination range satisfying luminous intensity distribution specification to be met.

Thus direct and reflected light from the light source bulb and the reflector is controlled by the prism elements constituting the light-transmitting portion of the lens, so as to obtain an illumination range of luminous intensity distribution specification to be met.

The light-transmitting portion of the lens is zoned into a central section and two lateral sections of the central section. The central section and the lateral sections are respectively divided into a plurality of blocks. The prism elements of the blocks in the central section are configured with reflected light from the reflector as reference light, and those in the lateral sections are configured with direct light of the light source bulb as reference light.

The central portion of the light-transmitting portion of the lens is the portion where reflected light from the reflector transmits most while the reflected light is dissipated outside a desired range most. The lateral sections are the portions where direct light of the light source bulb is dissipated outside a desired range most. The designing of the prism shapes in the central and lateral sections with reflected light of the reflector and the direct light of the light source bulb as reference light, respectively, controls the reflected and direct light dissipated with efficiency to make the dissipated light irradiate within a desired range of luminous intensity distribution specification.

The central section and the lateral sections of the light-transmitting portion of the lens are respectively divided into a plurality of blocks. This adjusts in position illumination ranges of reflected light of the reflector and direct light of the light source bulb within luminous intensity distribution specification in good balance.

Each block is composed of a set of the prism elements. This enables high precision control of an illumination position of each block.

Each lateral section is further zoned, in the same direction as in the above zoning, into a plurality of zones. The prism elements constituting the lateral section and being in a zone distanced farther from the light source bulb are configured to have a greater horizontal projection angle.

This provides sufficient light irradiation to both sides of an intensity-distribution-specification line diagram to be met.

The light source bulb has a vertical filament. The prism elements are formed in a lattice.

The vertical filament of the light source bulb allows the vertical diffusion angle of the prism elements at 0°. Thus using the same design of the prism elements provides the same functional effects irrespective of difference in the installing position of the lens (whether the surface opposing to the light source bulb is flat or inclined).

Forming the prism elements in a lattice facilitates luminous intensity distribution designing, and manufacturing of the prism elements.

While preferred embodiments of this invention have been described using specific terms, such description is for illustrative purposes, and it is to be understood that changes and variations may be made without departing from the spirit or scope of the following claims.

What is claimed is:

1. A vehicular lamp comprising:

a light source bulb;

a reflector for reflecting light from the light source bulb; and a lens provided with a light transmitting portion formed with a set of prism elements for reflected light from the reflector and direct light from the light source bulb to strike thereto, the set of prism elements being configured for controlling the reflected light and the direct light to give a distribution of required luminous intensities in a prescribed light distribution range, wherein the light transmitting portion of the lens comprises:

a peripheral part including a first partial set of the set of prism elements configured to control the direct light as reference light; and a central part including a second partial set of the set of prism elements configured to control the reflected light as reference light.

2. A vehicular lamp according to claim 1, wherein the first partial set of the set of prism elements comprises first and second subsets thereof without intersection, the first subset being more spaced from an optical axis of the lens than the second subset, the prism elements of the first subset having a greater light projection angle relative to the optical axis than the prism elements of the second subset.

3. A vehicular lamp according to claim 1, wherein the light source bulb has a vertical filament, and the set of prism elements comprises a matrix of prism elements.

4. A vehicular lamp according to claim 1, wherein each of the prism elements includes a recessed spherical surface on a top portion thereof.

* * * * *